United States Patent [19]

Bühler et al.

[11] Patent Number: 4,571,246

[45] Date of Patent: Feb. 18, 1986

[54] PROCESS FOR THE PRODUCTION OF DISCHARGE RESIST PRINTS ON HYDROPHOBIC TEXTILE MATERIALS: HYDROGEN SULPHIDE SALT, POLYSULPANE OR THIOLATE

[75] Inventors: Ulrich Bühler, Alzenau; Theo Stahl; Konrad Mix, both of Frankfurt; Kurt Roth, Hofheim, all of Fed. Rep. of Germany

[73] Assignee: Cassella Aktiengesellschaft, Frankfurt am Main, Fed. Rep. of Germany

[21] Appl. No.: 651,590

[22] Filed: Sep. 17, 1984

[30] Foreign Application Priority Data

Oct. 28, 1983 [DE] Fed. Rep. of Germany ..... 3339158

[51] Int. Cl.[4] ..... D06P 1/16; D06P 3/26; D06P 5/15

[52] U.S. Cl. ..... 8/456; 8/451; 8/464; 8/466; 8/575; 8/586; 8/921; 8/922

[58] Field of Search ..... 8/456, 464, 575, 586, 8/587

[56] References Cited

U.S. PATENT DOCUMENTS

| | | | |
|---|---|---|---|
| 4,400,174 | 8/1983 | Blum et al. | 8/456 |
| 4,421,516 | 12/1983 | Stahl et al. | 8/464 |

FOREIGN PATENT DOCUMENTS

| | | |
|---|---|---|
| 44601 | 1/1982 | European Pat. Off. . |
| 3128984 | 3/1982 | Fed. Rep. of Germany . |
| 3132416 | 2/1983 | Fed. Rep. of Germany . |

*Primary Examiner*—A. Lionel Clingman

*Attorney, Agent, or Firm*—Connolly and Hutz

[57] ABSTRACT

An improved process for production of discharge resist prints on textile material which contain hydrophobic fibers wherein at least one disperse dyestuff dischargeable to white discharge-resistant disperse dyestuff is applied, in the form of a dye liquor or printing paste, to the textile material and a discharge resist printing paste is printed on the material in the desired pattern, and the material is subsequently subjected to heat treatment at 100° to 230° C., wherein the improvement comprises the discharge resist printing paste containing, as the discharging agent, at least one salt of hydrogen sulphide, polysulphanes, compounds have a thiolate group of the formula $-S^{\ominus}$ or a tautomerizable thio-group of the formula $=S$, and mixtures thereof.

11 Claims, No Drawings

PROCESS FOR THE PRODUCTION OF DISCHARGE RESIST PRINTS ON HYDROPHOBIC TEXTILE MATERIALS: HYDROGEN SULPHIDE SALT, POLYSULPANE OR THIOLATE

The present invention relates to a process for the production of discharge resist prints on textile materials which consist of hydrophobic fibres or contain the latter together with cellulose, in particular cotton, or together with wool, wherein one or more disperse dyestuffs which are dischargeable to white and, if appropriate, one or more discharge-resistant disperse dyestuffs are applied, in the form of a dye liquor or printing paste, to the textile material and are then carefully incipiently dried or dried, and a discharge resist printing paste which can, if desired, contain in addition one or more discharge-resistant disperse dyestuffs is then printed on in the desired pattern, it being also possible to exchange the sequence of printing on the discharge resist printing paste and the printing paste and, if a printing paste is used, for the incipient drying or intermediate drying also to be omitted, and the material is subsequently subjected to heat treatment at 100° to 230° C.

In textile printing it has always been a problem to produce white or coloured patterns with sharp outlines on a deeply coloured background. In particular, direct printing of the textile material fails completely when filigree-like patterns are produced on a dark substrate. In order to produce patterns of this type, it is known to print a discharge printing paste in the desired pattern on a deep background shade which has been produced by means of a dyestuff dischargeable to white, and then to destroy the dyestuff at the areas printed with the discharge printing paste, by means of a dry or wet heat treatment. When the prints thus obtained have been rinsed, the desired pattern is obtained in the form of white on a dark ground. It is also already known to add to the discharge printing pastes dyestuffs which are resistant to the discharging agent. In this case, the textile material is dyed at the printed areas by means of the indestructible dyestuff at the same time as the ground shade is destroyed. Coloured prints on a dark ground are obtained in this case. Coloured prints on a dark ground can also be obtained in the dark ground is produced using a mixture of a dischargeable dyestuff and a non-dischargeable dyestuff of a different colour.

When these known processes are applied to textile materials consisting of hydrophobic synthetic fibres, a problem arises insofar as it is very difficult to discharge, for example, polyester fibres which have been dyed with disperse dyestuffs. Disperse dyestuffs which have once been fixed, that is to say dissolved, in the polyester fibre are largely withdrawn from the access of aqueous agents and hence also from attack by aqueous discharge printing pastes. In the production of discharge prints on textile materials containing hydrophobic fibres or consisting of hydrophobic fibres, the known discharge printing process is therefore modified so that the textile material is first padded with a dye liquor containing a disperse dyestuff and is then dried or incipiently dried with such care that fixing of the dyestuff, that is to say solution of the dyestuff, in the hydrophobic fibre does not yet take place. The desired pattern is then printed on the dried or incipiently dried, padded fabric by means of the discharge printing paste, and the fabric thus treated is subsequently subjected to a heat treatment in which, simultaneously, the ground dyestuff at the areas not printed migrates into the polyester, that is to say becomes fixed, and the dyestuff at the areas printed with the discharge printing paste is destroyed, that is to say no dyeing takes place. This process is also known as discharge resist printing.

The process of discharge resist printing, which is in itself simple, contains a number of technical difficulties which frequently render its use difficult. Thus, as a rule, it is not easy to destroy the ground dyestuff completely by means of the discharging agent. If this is not successful, there remains on the discharged areas a coloured residue the shade of which can vary between yellow-brown and dull violet or reddish-tinged grey shades and which soils the white ground at the discharged areas. This results in white discharges which appear dirty or, in the event that a coloured discharge is to be produced, results in an adulteration of the shade of the discharge-resistant dyestuff.

In order to overcome this difficulty, use is made of discharge printing pastes containing relatively strong reducing or oxidising agents, such as, for example, alkali metal formaldehyde-sulphoxylates, or even heavy metal salts, such as, for example, tin-2 chloride. Although strong discharging agents of this type as a rule make it possible to achieve a satisfactory white discharge print, damage of the fibre material frequently takes place. Furthermore, these discharging agents are not cheap, as a rule. If zinc-2 chloride is used, the hydrochloric acid which is split off causes considerable corrosion in the steamers.

One proposal for avoiding the use of reducing metal salts or at least for reducing their quantitative proportion in discharge printing pastes consists in employing, as discharging agents, organic compounds which exert a reducing effect on the organic dyestuffs, such as thiourea, isothiourea or the selenium analogues thereof. However, since the discharging action of these compounds is not, as a rule, adequate, it is necessary to add, to the preferred embodiments of the process, metal salts with their disadvantages which were mentioned initially.

The use of reducing sugars in the presence of alkali is described as a discharging agent in Japanese Patent Application Nos. 56-165,079 (cf. Abstract No. 08880 E/05 in Central Patents Index (Derwent Publications Ltd., London)), 56-159,378 (cf. Abstract No. 05087 E/03, Derwent loc.cit.), 57-029,683 (cf. Abstract No. 24758 E/13, Derwent loc.cit.), 57-029,684 (cf. Abstract No. 24759 E/13, Derwent loc.cit.), and 57-029,685 (cf. Abstract No. 24760 E/13, Derwent loc.cit.).

A similar process is described in German Offenlegungsschrift No. 3,128,984: in this case the discharging agent employed is a combination of reducing sugars with polyhydric alcohols, thioglycol also being mentioned, inter alia, and optionally with salts of thiocyanic acid. In addition to the discharging action of the reducing sugars being insufficient here too in many cases, a principal defect of these discharging agents consists in the fact that the prints produced therewith do not have sharp outlines, that is to say the boundary of the discharge pattern is not sharp, which cannot be tolerated, above all in the case of filigree-like patterns.

German Offenlegungsschift No. 3,113,732 (corresponding to U.S. Pat. No. 4,400,174) relates to a discharge or discharge resist printing process for textile materials composed of hydrophobic fibres, in which the discharging agent employed is a combination of an organic reducing agent with alkoxylated amines, the reducing agents used being alkylsulphinates, reducing monosaccharides or disaccharides and/or thiourea dioxide.

In the field of the discharge resist printing of cellulose textiles with phthalocyanine condensation dyestuffs (so-called ingrain dyestuffs), it is known from German Offenlegungsschrift No. 3,132,416 to employ water-soluble organic derivatives of thiocarbonic acid or thiophosphoric acid as discharging agents. These substances prevent the formation of the phthalocyanine dyestuffs from the polyisoindolenine/metal complexes which have been printed on.

In order to avoid the use of metallic reducing agents and to be able to use less effective reducing agents, it has also already been proposed to employ, for dyeing the background, disperse dyestuffs of a type which can be discharged to give pure white by means of agents having as gentle an action as possible. German Offenlegungsschriften Nos. 2,612,740 (corresponding to South African Pat. No. 76/1390), 2,612,741 (corresp. to U.S. Pat. No. 4,134,723), 2,612,742 (corresp. to British Pat. No. 1,536,429), 2,612,790 (corresp. to U.S. Pat. No. 4,313,874), 2,612,791 (corresp. to British Pat. No. 1,518,290), 2,612,792 (corresp. to British Pat. No. 1,521,122), 2,836,391 (corresp. to U.S. Pat. No. 4,252,530), 3,021,269 (corresp. to U.S. Pat. No. 4,406,661) and 3,035,912 (corresp. to British Pat. No. 2,060,672 disclose dyestuffs which can be discharged by aqueous alkalis, in the course of which either their chromophore is destroyed or their carboxylic ester or sulphonamide groups are converted into a saltlike structure, as a result of which the dyestuffs lose their affinity for the fibre. The use of dyestuffs of this type in accordance with the processes described results, on polyesters, in damage to the fibre caused by saponification, which cannot be tolerated, particularly in the case of very light and thin qualities. In addition, dyestuffs of this type can, as a rule, only be prepared by special and expensive processes and from precursors specially produced for this type of dyestuff. In addition, however, they also exhibit defects in application. Thus they display, after being discharged, a certain affinity for hydrophilic accompanying fabrics and soil the latter, or they have a tendency to thermomigration, or they have a poor affinity and thus have only a poor dyestuff yield on the fibre. In addition, their special structure also has in most cases in adverse effect on the fastness properties in use, such as, for example, fastness to light and fastness to thermofixing.

It has now been found, surprisingly, that conventional disperse dyestuffs belonging to the azo series are also suitable for use as dyestuffs dischargeable to white for discharge resist printing on hydrophobic textile materials if a discharge resist printing paste is used, in the process described initially, which contains, as the discharging agent, one or more salts of hydrogen sulphide or of the polysulphanes, and/or one or more compounds which have a thiolate structure or can form such a structure, if appropriate in combination with thiourea and/or salts of thiocyanic acid.

Compounds having a thiolate structure are those which contain at least one thiolate structure ($-S^{\ominus}$) or a thiostructure ($=S$) which is capable of tautomerism, such as, for example, salts of thio-derivatives of carbonic or phosphoric acid, salts of aromatic or aliphatic thiocarboxylic or dithiocarboxylic acids or salts of thiols.

Examples of compounds which can form a thiolate structure are the acids corresponding to the thiolates mentioned above, in combination with inorganic or organic bases which produce a pH of at least 8 in water.

It is also possible to employ, as discharge resist agents according to the invention, compounds which decompose as the result of thermolysis or in the course of hydrolysis into cleavage products containing thiolate groups. Examples of suitable thermolysable compounds are aromatic or aliphatic disulphides, which are optionally employed in combination with inorganic or organic bases. Examples of suitable hydrolysable compounds, especially in an alkaline medium, are the alkyl or aryl esters of thiocarbonic acid, thiocarboxylic acid or thiophosphoric acid derivatives.

Derivatives of carbonic or phosphoric acid which are suitable for use as discharge resist agents according to the invention and which contain at least one thiolate structure or a thio-structure capable of tautomerism, are those of the formula I

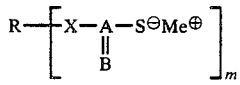

(I)

wherein A denotes a carbon atom or one of the groups $P\text{-}NR^1R^2$, $POR^2$ or $PSR^2$; B denotes oxygen, sulphur or a group $=NR^2$; X denotes a direct bond, oxygen, sulphur or a group $-NR^2-$; R denotes hydrogen, an m-valent, optionally substituted alkane radical which can be interrupted by a 1,2-, 1,3- or 1,4-phenylene radical or, provided that the chain length is $\geqq 3$, by —O—, —S— or $-NR^2-$, once or several times, at an interval of at least 2 C atoms, or by divalent radicals of the formulae

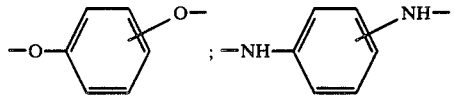

once or twice at an interval of at least 2 C atoms; or denotes an m-valent, optionally substituted cycloalkane radical or alkene radical; or an m-valent radical of a trialkylamine or polyalkylalkylenepolyamine in which the alkyl groups, provided that their chain length is $\geqq 3$, can be interrupted by —O—, —S— or $-NR^2-$, once or several times at an interval of at least 2 C atoms; $R^1$ denotes hydrogen or an optionally substituted alkyl radical which, provided that its chain length is $\geqq 3$, can be interrupted by —O—, —S— or $-NR^3-$, once or several times at an interval of at least 2 C atoms, or by divalent radicals of the formulae

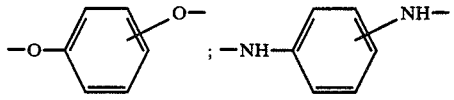

once or twice; or denotes an optionally substituted cycloalkyl radical or alkenyl radical; $R^2$ has one of the meanings mentioned for $R^1$ and additionally also represents an optionally substituted aryl or heteroaryl radical; $R^1$ and $R^2$, together with an N atom to which they are attached, form an N-pyrrolidine, N-piperidine, N-piperazine, N-morpholine or N-thiomorpholine radical;

$R^3$ denotes hydrogen or alkyl, alkenyl or cycloalkyl which is optionally substituted by halogen, -OH or alkoxy, and, if appropriate, R—X— together also represent cyano; m is a number from 1 to 3 and $Me^{\oplus}$ represents an equivalent of a cation of an alkali or alkaline earth metal or an optionally substituted ammonium ion.

Monovalent alkane radicals represented by R are branched or, preferably, linear alkyl radicals; m-valent alkane radicals are radicals derived from branched or, preferably, linear alkanes by replacing m hydrogen atoms by

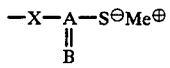

If the carbon chain of the alkane radical is interrupted by a phenylene radical, the 1,3-phenylene and 1,4-phenylene radicals are preferred. If the alkane radical is interrupted by radicals of the formula

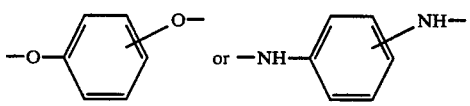

here too the 1,3-position and 1,4-position in the phenylene radicals are preferred, as is also a single interruption. Of the alkane radicals which are interrupted by —O—, —S— or —$NR^2$—, those which are interrupted by —O— are preferred. If the alkane chains are interrupted by —S— or —$NR^2$—, preferably only one —S— or —$NR^2$— group is present. This also applies if, as well as the interruption by —S— or —$NR^2$—, the alkane chain also contains further interruptions by —O—.

Thus, of interrupted alkane chains of this type, preferred examples are those of the formulae $$-CH_2CH_2-O-CH_2CH_2-NR^2-CH_2CH_2-O-CH_2CH_2-$$

or $$CH_2CH_2-O-CH_2CH_2-S-CH_2CH_2-O-CH_2CH_2-.$$

m-valent radicals R derived from trialkylamines are preferably trivalent. They correspond to the formula

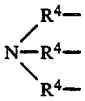

wherein $R^4$ once again has the definition applying to divalent radicals R. The radicals $R^4$ are preferably divalent alkane radicals which are optionally substituted and, if the chain length is ≧3, can be interrupted by —O— once or several times at a distance of at least 2 C atoms.

m-valent radicals R derived from polyalkylalkylenepolyamines correspond to the formula

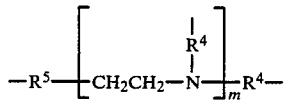

wherein $R^5$ is a direct bond or a radical $R^4$.

In order to simplify the description, in the text which follows "discharging agents having a thiolate structure" should also be understood to mean compounds which are capable, under suitable environmental conditions, of forming a thiolate structure (for example corresponding acids or precursors which can be cleaved by hydrolysis or thermolysis).

Suitable discharging agents of the formula I capable of being employed in accordance with the invention can be derived from the thiocarbamate series. In this case A denotes a C atom, B an O atom and X a group —$NR^2$—.

A further group of discharging agents of the formula I capable of being employed in accordance with the invention is derived from the series of the trithiocarbonic acid derivatives, A being a C atom, B being an S atom and X also being an S atom.

Further groups of discharging agents of the formula I capable of being employed in accordance with the invention belong to the cyanodithioformic acid series (A=a C atom; B=an S atom; and R—X— denotes a cyano group) or to the trithiophosphoric acid ester series (A=$POR^1$; B=an S atom; and X=an S atom).

A further group of discharging agents of the formula I capable of being employed in accordance with the invention is formed by the salts of thiocarbonic or dithiocarbonic acids in which A is a C atom, B is an O or S atom and X is a direct bond.

Discharging agents of the formula I which are preferentially capable of being employed in accordance with the invention are compounds belonging to the dithiocarbamate series, A being a C atom, B being an S atom and X being a group —$NR^2$—, and to the dithiophosphoric acid ester series, A representing $POR^2$, B representing an S atom and X representing an O atom.

Particularly preferred discharging agents of the formula I capable of being employed in accordance with the invention are compounds of the xanthate series, A being a C atom, B being an S atom and X being an O atom.

In the groups of discharging agents listed above, the symbols R, $R^1$ and $R^2$ have the meanings mentioned earlier in the text.

Optionally substituted m-valent alkane, cycloalkane or alkene radicals represented by R and also alkyl, alkenyl or cycloalkyl radicals represented by $R^1$ or $R^2$, are alkane or alkyl, respectively, radicals having 1 to 12 C atoms, cycloalkane or cycloalkyl, respectively, radicals having 5 or 6 C atoms or alkene or alkenyl, respectively, radicals having 3 to 5 C atoms, and these radicals can be substituted by fluorine, chlorine, bromine, hydroxyl, alkoxy having 1 to 4 C atoms, phenoxy, phenyl, benzyl, phenethyl, cyano, carboxyl or alkoxycarbonyl having a total of up to 8 C atoms or by an alkyl radical of the formula II $$-O-[DO]_r[D'O]_tR^6 \quad (II)$$

In the above formula II, D and D' independently of one another denote linear or branched alkylene radicals having 2 to 6 C atoms, $R^6$ denotes hydrogen, alkyl having 1 to 8 C atoms, cycloalkyl having 5 or 6 C atoms, alkenyl having 3 to 5 C atoms, phenyl, benzyl, phenethyl or cyanoethyl, r denotes the numerical values 0 to 10 and t denotes the numerical values 0 and 1, the sum of r and t being $\geqq 1$.

The number of the abovementioned substituents which are attached to the hydrocarbon radicals represented by R, $R^1$ and $R^2$ depends on their structure. Of simple substituents, such as halogen atoms, hydroxyl or lower alkoxy, it is possible for 1 to 6, preferably 1 to 3, identical or different substituents to be attached to one of the hydrocarbon radicals. More extensive substituents, such as those containing a phenyl nucleus, and also substituents having fairly strong effects on neighbouring groups, such as cyano, carboxyl or alkoxycarbonyl, are only present once, as a rule. Single substitution is preferred overall.

Optionally substituted aryl radicals which can be represented by R and $R^2$ are phenyl, 1-naphthyl and 2-naphthyl radicals, and these can be monosubstituted to trisubstituted by fluorine, chlorine, bromine, alkyl having 1 to 4 C atoms, alkoxy having 1 to 4 C atoms, nitro, cyano, carboxyl, alkoxycarbonyl having 1 to 4 C atoms, monoalkylaminocarbonyl or dialkylaminocarbonyl having 1 to 4 C atoms in each alkyl radical, hydroxysulphonyl, alkoxysulphonyl having 1 to 4 C atoms, alkylsulphonyl having 1 to 4 C atoms in the alkyl radical, phenylsulphonyl or monoalkylaminosulphonyl or dialkylaminosulphonyl having 1 to 4 C atoms in each alkyl radical.

m-valent aromatic radicals represented by R are 1,2-, 1,3- and 1,4-phenylene or 1,2-, 1,4-, 1,6- or 1,8-naphthylene. The phenylene radicals are preferred, particularly the 1,3-phenylene radical and very particularly the 1,4-phenylene radical.

Preferred monovalent radicals R or preferred radicals $R^1$ and $R^2$ are alkyl radicals which have 1 to 4 C atoms and which can be substituted, in particular monosubstituted, by hydroxyl, alkoxy having 1 to 4 C atoms, phenoxy, phenyl, chlorine, bromine or cyano. A further preferred meaning of $R^1$ is hydrogen.

Preferred divalent radicals R are ethylene and polymethylene having 3 to 6 C atoms, which radicals, provided that they contain 2 or more C atoms, can be interrupted by phenylene or, if they contain 4 or more C atoms, can be interrupted by 1 to 2 oxygen atoms at an interval of at least 2 C atoms, or are the 1,4-phenylene radical.

Examples of alkali or alkaline earth metals the cation of which is represented by $Me^{\oplus}$ are lithium, sodium, potassium, magnesium, calcium, strontium and barium.

Ammonium ions represented by $Me^{\oplus}$ can carry up to 2 radicals having the meaning of $R^1$ and one radical having the meaning of $R^2$, or can be derived from a 5-membered or 6-membered ring nitrogen heterocyclic compound such as, for example, pyridine, lutidine or pyrrolidine.

Preferred cations are the ammonium ion and ammonium ions carrying up to 3 alkyl radicals which have 1 to 4 C atoms and which are optionally substituted by hydroxyl or alkoxy having 1 to 4 C atoms.

Cations $Me^{\oplus}$ which are very particularly preferred are the sodium ion or the potassium ion.

In addition to the discharging agents of the formula I, it is also possible to employ, in accordance with the invention, salts of optionally substituted aliphatic or aromatic thiols of the general formula III $$R-[S^{\ominus}Me^{\oplus}]_m \qquad \text{(III)}$$

in which R has the meanings mentioned above, with the exception of hydrogen.

Preferred salts of aliphatic thiols are the monovalent and divalent salts of thioglycollic acid. The sodium and potassium salts are particularly preferred in this respect.

Examples of corresponding acids which can form compounds having a thiolate structure with inorganic or organic bases are thiols, such as the esters of thioglycollic acid, and preferably thioglycollic acid.

Examples of inorganic bases within the meaning of the above statements are the hydroxides, oxides or salts of weak acids, such as the carbonates, bicarbonates, phosphates, hydrogen phosphates and acetates of the abovementioned metals of which the cation can be represented by $Me^{\oplus}$; examples of organic bases are the amines corresponding to the abovementioned ammonium ions.

Preferred discharging agents which can be employed in accordance with the invention are also the salts of hydrogen sulphide $HS^{\ominus}Me^{\oplus}$ and $S^{2\ominus}Me^{61}{}_2$ and also the polysulphanes $Me^{\oplus}{}_2S_x$ having 2 to 4, preferably 2, S atoms.

A further class of discharging agents which can be employed in accordance with the invention is formed by disulphides which can decompose by heat, particularly in the presence of bases, into compounds having a thiolate structure, such as, for example, the thiurams of the general formula IV

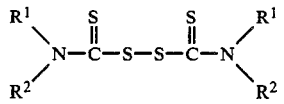

(IV)

compounds of the general formulae V and Va

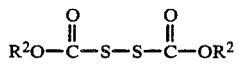

(V)

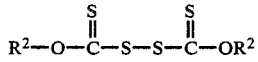

(Va)

or, for example, di-(hydroxycarbonylmethyl) disulphide.

Examples of compounds which can liberate compounds having a thiolate structure as the result of alkaline hydrolysis are di-(hydroxycarbonylmethyl) trithiocarbonate or the internal salt of S-hydroxycarbonylmethylthiourea.

A requirement for using compounds which form a thiolate structure as the result of neutralisation, thermal decomposition or alkaline hydrolysis is that this formation is complete and the compound having the thiolate structure can still have a discharging effect on the dyestuff by the process according to the invention, before this dyestuff is fixed on the fibre.

Combinations of salts of thiocyanic acid with compounds which have a thiolate structure or can form a thiolate structure are combinations of, for example, sodium, potassium or ammonium thiocyanate with compounds of the formulae I to V, in particular with salts belonging to the series comprising the dithiocarbamates, dithiophosphoric acid esters, xanthates or thioglycollic acid.

The discharging agents which can be employed in accordance with the invention can be employed as an individual substance. However, by virtue of their compatibility with one another, it is also possible to use combinations of several discharging agents according to the invention.

The discharging agents which can be employed in accordance with the invention can also be employed in combination with inorganic or organic bases which produce a pH of at least 8 in water, in order to form a discharge resist for dyestuffs which would not be completely discharged by these bases alone or for which these bases would have to be employed in such large quantities that damage to the fibre would occur.

Suitable discharge resist printing pastes are any preparations which allow the abovementioned discharging agents to be applied to the fabric and which ensure, under the application conditions, as level as possible a release of the printing paste to the fabric and which provide a print having the sharpest possible outlines. The discharge resist printing pastes to be used in accordance with the invention are prepared by adding the compounds which have a thiolate structure or can form such a structure to the printing pastes which are generally used. It is preferable to add the discharging agents as early as when the printing pastes are being prepared from the starting constituents. As a rule, concentrations of the discharging agent in the discharge resist printing pastes of 0.1 to 250 g/kg, preferably 1 to 130 g/kg, are necessary in order to ensure, at the amounts of the discharge resist printing paste which are generally used for application, that the quantity of discharging agent required for the discharging process is present on the substrates to be printed. This quantity depends on the depth of colour of the dyeing, the dischargeability of the dyestuffs used and the activity of the discharging agent. As a rule, at the customary application quantities of the discharge printing paste and at the concentrations indicated, the discharging agent is used in a molar ratio of discharging agent to dyestuffs being discharged of 1:(1 to 10,000).

As usual, in addition to the discharging agents, the discharge resist printing pastes also contain water, thickeners and auxiliaries (for example swelling agents, dispersing agents and fixing accelerators) and, if appropriate, discharge-resistant dyestuffs. The following are examples of suitable thickeners for discharge resist printing pastes to be used in accordance with the invention: starch degradation products, such as dextrin; nonionic starch derivatives, such as British gum; types of gum, such as gum arabic; locust bean flour, in particular locust bean flour ether, and tragacanth; guar derivatives, in particular guar ether, and cellulose ether carboxylic acids. Furthermore, the discharge resist printing pastes can also contain in addition other customary auxiliaries and additives, such as, for example, hydrotropic substances, and also additives which promote wetting, penetration and uptake of dyestuff. A factor which is particularly advantageous for the discharging process is the presence of nonionic detergents or solubilisers which are preferably contained in the discharge resist printing pastes, such as, for example, glycerol and/or polyglycols, such as polyethylene glycol having an average molecular weight of of 300 to 500 and/or polypropylene glycols, sucn as are described, for example, in German Offenlegungsschrift No. 2,951,312, or products based on N,N-dialkyl-substituted lower carboxamides, such as, for example, N,N-dicyanoethylformamide. Coloured designs can be achieved by also incorporating discharge-resistant disperse dyestuffs in the discharge resist printing pastes. Preferably, the discharge resist printing pastes used in accordance with the invention contain no reducing or oxidising agents apart from the discharging agents to be employed in accordance with the invention.

Any disperse dyestuffs, of which the chromophore is destroyed by the discharge resist printing pastes and/or which are converted by these discharge resist printing pastes into a form which is not absorbed onto the hydrophobic fibres can be discharged by the process according to the invention. Dyestuffs which can be discharged by the process according to the invention are especially monoazo and disazo dyestuffs.

Examples of monoazo dyestuffs which can be discharged by the process according to the invention are those having carbocyclic or heterocyclic diazo components and/or coupling components belonging to the series comprising the anilines, naphthylamines, phenols, naphthols or 5-membered or 6-membered ring heterocyclic compounds, which can, if appropriate, be fused with benzene. Examples of suitable disazo dyestuffs are those in which the middle component is derived from anilines, naphthylamines or 5-membered or 6-membered ring heterocyclic amines. The following are examples of dischargeable azo dyestuffs: C.I. Disperse Yellow 7, 23, 68, 103 and 180; C.I. Disperse Orange 1, 3, 5, 13, 18, 19, 20, 21, 25, 29, 30, 33, 38, 44, 55, 61, 66, 71, 81, 96, 127, 128 and 130; C.I. Disperse Red 1, 2, 5, 7, 13, 17, 43, 50, 54, 56, 65, 73, 76, 82, 90, 134, 151, 160, 167, 168, 177, 180, 183, 184, 202, 203, 279, 281, 311, 312 and 324; C.I. Disperse Violet 12, 13, 24, 48, 58, 63 and 33; C.I. Disperse Blue 79, 85, 94, 122, 125, 130, 139, 148, 149, 165, 165/1, 165/2, 171, 183, 284, 287, 290, 295 and 330; C.I. Disperse Brown 1, 4/1 and 19; C.I. Disperse Green 9.

The process according to the invention is suitable for textile materials which consist of hydrophobic fibres, for example polypropylene, polyacrylonitrile, polyamide and cellulose triacetate, but particularly polyester fibres, but is also suitable for textile materials which contain these hydrophobic fibres as a mixture with cellulose, in particular cotton, or as a mixture with wool. Examples of suitable polyester fibres are those based on polybutylene terephthalate and poly-1,4-cyclohexylenedimethylene terephthalate, but especially polyethylene terephthalate, it being also possible for these polyesters, with regard, for example, to more ready affinity for dyes, to be modified, for example by the co-condensation of other components, for example other dicarboxylic acids and/or other diols. The process according to the invention is, however, also suitable for textile materials which contain the hydrophobic fibres to a preponderant extent alongside other fibres, such as, for example, staple rayon or cotton. In this regard, textile materials which are particularly suitable are those which still give a uniform appearance when dyed or printed with disperse dyestuffs. The textile material can be in the form, for example, of random fleeces, felts, carpets, woven, weft-knitted or warp-knitted webs or pieces.

The process according to the invention is carried out by applying the disperse dyestuffs which are dischargeable to white to the textile material in the form of dye liquors or printing pastes. If a dye liquor is used, the textile material is impregnated therewith, for example in a manner which is in itself known, for example padded or slop-padded. The dye liquors or printing pastes can contain one or more of the said disperse dyestuffs which are dischargeable to white, together with known customary dyeing or printing auxiliaries, such as, for example, dispersing agents, wetting agents, anti-foaming agents and padding auxiliaries. The impregnated textile material is squeezed out to a 50 to 120% liquor pick-up. The textile materials thus treated are then dried sufficiently carefully for no fixing of the dyestuff in the fibre to take place yet. This can be effected, for example, by hot air, if necessary preceded by infrared irradiation, the temperature being approx. 60° to 80° C., or not more than about 100° C. with a corresponding shortening of the time. The textile materials which have been pretreated in this way are then printed in the desired pattern with one of the abovementioned discharge resist printing pastes. The impregnated and printed textile materials are then subjected to a heat treatment at 100° to 230° C. Within the lower temperature range, up to approx. 130° C., the heat is preferably supplied by steam under pressure. For heat treatments carried out at 160° to 230° C. the heat transfer agent used is preferably superheated steam or hot air. If steam is used for the heat treatment, drying is carried out at 60° C. to not more than 100° C., for example by hot air perhaps preceded by infrared irradiation, prior to the heat treatment. In the case of some discharging agents which only form a compound having a thiolate structure in the course of the heat treatment, the presence of small quantities of water during the heat treatment can be necessary. In the case of discharging agents of this type, the heat treatment is preferably carried out with superheated steam, in particular at 170° to 200° C. After the heat treatment, which results in the disperse dyestuffs being fixed at the areas which have not been overprinted with discharge resist printing paste, and in the disperse dyestuffs being destroyed at the areas which have been printed with the discharge resist printing paste, the textile materials are subjected to aftertreatment in the customary manner, rinsed under hot and cold conditions and dried.

A particular embodiment of the process according to the invention consists in the dye liquor additionally containing, besides disperse dyestuffs which are dischargeable to white, one or more disperse dyestuffs which are resistant to the discharging agents according to the invention and are thus not destroyed. Multicoloured designs are obtained if the process is carried out in other respects as indicated above.

As already mentioned, it is also possible to print the disperse dyestuffs which are dischargeable to white onto the textile material in the form of printing pastes and then to overprint in the desired pattern with the discharge resist printing paste. Incipient drying or intermediate drying between the two printing processes is not absolutely necessary, so that it is also possible to carry out a wet-on-wet process. The textile prints are then fixed and finished subsequently, as already described above. In this process too, it is possible to add one or more discharge-resistant disperse dyestuffs to the colour printing paste initially printed on, which can also contain several white-dischargeable disperse dyestuffs of the type mentioned. Multi-coloured designs are also obtained in this case. A further possible means of carrying out the process according to the invention consists in printing, onto the ground which has been impregnated or printed with disperse dyestuffs which are dischargeable to white, discharge resist printing pastes of the type mentioned which, in turn, contain one or more resistant disperse dyestuffs. Here too, multi-coloured designs are obtained when the textile materials are subsequently fixed and finished as described above.

Finally, it is also possible first to print onto the textile material, in the desired pattern, a discharge resist printing paste containing one or more discharging agents of the type mentioned, and to overprint the textile material thus printed, after incipient or intermediate drying or without incipient or intermediate drying, that is to say "wet-on-wet", with a printing paste containing one or more dyestuffs which are dischargeable to white. In order to fix the dyestuff at the areas not covered with discharge resist printing paste and to destroy the dyestuff at the areas covered with discharge resist printing paste, the textile material which has been treated in this way is subjected to the heat treatment already mentioned above and is finished as already indicated above. In this case multicoloured patterns are obtained if the discharge resist printing paste also contains, additionally, one or more discharge-resistant disperse dyestuffs and/or if the printing paste, in addition to one or more disperse dyestuffs which are dischargeable to white, also contains one or more discharge-resistant disperse dyestuffs.

The dyestuffs are present in the padding liquors or printing pastes or in the discharge resist printing pastes in a finely dispersed form, such as is customary and known for disperse dyestuffs. The preparation of the padding liquors or printing pastes which are to be employed in accordance with the invention is also effected in a manner which is in itself known by mixing the constituents of the liquors or printing pastes with the required amount of water and liquid, finely disperse or solid, redispersible formulations of the dyestuffs.

Examples of discharge-resistant disperse dyestuffs which can be combined with the dischargeable dyestuffs in order to produce multi-coloured designs are anthraquinone, naphthalimide, nitro, quinophthalone or methine dyestuffs, and examples of suitable discharge-resistant dyestuffs are C.I. Disperse Yellow 54 and 58; C.I. Disperse Orange 146; C.I. Disperse Red 60, 91, 92 and 132; C.I. Vat Red 41; C.I. Disperse Violet 35; C.I. Disperse Blue 56 and 87.

It is also possible, when producing white discharges, to add discharge-resistant optical brighteners to the discharge resist printing pastes which are used in accordance with the invention.

In the examples which follow, the relationship between parts by weight and parts by volume is that of kilogrammes to liters.

EXAMPLE 1

A polyester woven fabric is padded at 20° to 30° C., with a squeezing out effect of 70%, with a liquor consisting of 20 parts by weight of the liquid commercial form of C.I. Disperse Blue 165, 3 parts by weight of citric acid, 20 parts by weight of an anti-migration agent based on polyacrylamide and 877 parts by weight of water, and is carefully dried at 60° to 80° C. The fabric is then overprinted with a pattern using a discharge resist printing paste containing 500 parts by weight of a 14% strength locust bean flour ether thickener, 80 parts by weight of glycerol, 80 parts by weight of polyglycol 400 and 50 g of potassium xanthate in 1000 parts by weight. After thermosol treatment for 1 minute at 200° C., reductive after-treatment, soaping and subsequent rinsing and drying, a white discharge, on a blue ground, which has sharp outlines and very good tinctorial fastness properties is obtained.

EXAMPLE 2

A polyester woven fabric is padded and dried as described in Example 1. A pattern is then overprinted using a discharge resist printing paste containing 375 parts by weight of a 14% strength locust bean flour ether thickener, 125 parts by weight of a 5% starch ether thickener, 20 parts by weight of glycerol and 80 parts by weight of polyglycol 400, 1 part by weight of thioglycollic acid and 40 parts by weight of potassium carbonate in 1000 parts by weight. After fixing by means of superheated steam for 7 minutes at 175° C. and finishing as in Example 1, a white discharge, on a blue ground, which has sharp outlines and very good tinctorial properties is obtained.

EXAMPLE 3

A polyester woven fabric is padded and dried as described in Example 1 with a liquor which, however, instead of C.I. Disperse Blue 165, contains 20 parts by weight of the liquid commercial form of C.I. Disperse Brown 1. Overprinting is then carried out as in Example 1 using a padding liquor which, however, instead of potassium xanthate, contains 2 parts by weight of sodium sulphide and 80 parts by weight of potassium carbonate, and the fabric is fixed and subjected to aftertreatment. This gives a white discharge, on a red-brown ground, which has sharp outlines and very good tinctorial properties.

EXAMPLE 4

A polyester woven fabric is printed by the screen printing process with a discharge resist printing paste consisting of 500 parts by weight of a 5% strength locust bean flour thickener, 80 parts by weight of glycerol, 80 parts by weight of polyglycol 400, 80 parts by weight of potassium xanthate, 20 parts by weight of a padding auxiliary based on fatty acid polyglycol esters and 220 parts by weight of water. Without intermediate drying, the fabric is then overprinted "wet-on-wet" with a printing ink consisting of 20 parts by weight of C.I. Disperse Blue 165/1, 300 parts by weight of a low-viscosity alginate thickener (10% strength) and 200 parts by weight of a starch ether (120% strength), 5 parts by weight of deliming agent based on polyphosphate and 3 parts by weight of citric acid in 1000 parts by weight. After being dried, the fabric is steamed for 7 minutes at 175° C., then subjected to reductive aftertreatment with 2 parts by weight of hydrosulphite and 3 parts by volume of 50% strength sodium hydroxide solution for 15 minutes at 80° C., rinsed, soaped and dried. A white pattern on a blue ground is obtained.

EXAMPLE 5

A cellulose triacetate woven fabric is padded and carefully dried as described in Example 1 using a liquor containing, as the dyestuff, 30 parts by weight of the liquid commercial form of C.I. Disperse Yellow 180 in 1000 parts by volume. A pattern is then overprinted as in Example 1 using a discharge resist printing paste, and the fabric is dried. After being fixed with superheated steam for 7 minutes at 175° C., the print is rinsed, neutralised, soaped and dried. The printed areas appear white on a yellow ground.

EXAMPLE 6

A polyester woven fabric is padded and dried as described in Example 1. A pattern is then overprinted as in Example 1 using a discharge paste which, however, instead of potassium xanthate, contains 2 parts by weight of thioglycollic acid and 80 parts by weight of potassium carbonate and, in addition, 40 parts by weight of the liquid commercial form of C.I. Disperse Red 303. After the fabric has been fixed by superheated steam for 7 minutes at 175° C. and subjected to an after-treatment as in Example 1, a brilliant red discharge, on a blue ground, which has sharp outlines and very good tinctorial properties is obtained.

EXAMPLE 7

A polyester woven fabric is padded and dried as described in Example 1. Overprinting is then carried out as in Example 2 using a discharge resist paste which, however, instead of the thioglycollic acid, contains 80 parts by weight of bis-(isopropoxythiocarbonyl) disulphide, and the fabric is fixed and subjected to aftertreatment. This procedure also gives a white discharge, on a blue ground, which has sharp outlines and very good tinctorial fastness properties.

What is claimed is:

1. In the process for production of discharge resist prints on textile material which contain hydrophobic fibers wherein at least one disperse dyestuff dischargeable to white with or without at least one discharge-resistant disperse dyestuff is applied, in the form of a dye liquor or printing paste, to the textile material and a discharge resist printing paste is printed on the material in the desired pattern, and the material is subsequently subjected to heat treatment at 100° to 230° C., wherein the improvement comprises the discharge resist printing paste containing, as the discharging agent, at least one salt of hydrogen sulphide, polysulphanes, compound having a thiolate group of the formula $-S^{\ominus}$ or a tautomerizable thiogroup of the formula $=S$, and mixtures thereof.

2. The process according to claim 1 wherein the discharging agent in the resist printing paste comprises dithiocarbonic acid compounds, salts thereof, dithiophosphoric acid compounds, salts thereof or mixtures thereof.

3. The process according to claim 2 wherein the discharging agent in the resist printing paste comprises a combination of dithiocarbonic acid compounds, dithiophosphoric acid compounds or salts thereof together with a thiourea salt of a thiocyanic acid, or mixtures thereof.

4. The process according to claim 1 wherein the discharge resist printing paste contains a xanthate as the discharging agent.

5. The process according to claim 1 wherein the discharge resist printing paste contains thioglycollic acid, thioglycollic acid salts or mixtures thereof in combination with inorganic or organic bases as the discharging agent.

6. The process according to claim 1 wherein the discharge resist printing paste contains dithiocarbamates or dithiophosphoric acid esters as the discharging agent.

7. The process according to claim 1 wherein the discharge resist printing paste contains at least one salt of hydrogen sulphide as the discharging agent.

8. The process according to claim 1 wherein following the application of the disperse dyestuff to the textile, the textile is at least incipiently dried.

9. The process according to claim 1 wherein the dye liquor or printing paste containing the disperse dyestuff dischargeable to white also contains at least one discharge-resistant disperse dyestuff.

10. The process according to claim 1 wherein the discharge resist printing paste also contains at least one discharge-resistant disperse dyestuff.

11. The process according to claim 1 wherein the discharge resist printing paste is printed onto the textile material before the disperse dyestuffs dischargeable to white are applied.

* * * * *